US011767707B2

(12) United States Patent
Warnock et al.

(10) Patent No.: US 11,767,707 B2
(45) Date of Patent: Sep. 26, 2023

(54) DOOR ASSEMBLY FOR AN ELECTROMAGNETIC SHIELDED ENCLOSURE

(71) Applicant: New England Lead Burning Company, Inc., Burlington, MA (US)

(72) Inventors: Seth Warnock, Chester, NY (US); Frank Leban, Orland Park, IL (US); Rodney Gebert, Hazelhurst, WI (US)

(73) Assignee: NEW ENGLAND LEAD BURNING COMPANY, INC., Burlington, MA (US)

( * ) Notice: Subject to any disclaimer, the term of this patent is extended or adjusted under 35 U.S.C. 154(b) by 0 days.

(21) Appl. No.: 17/672,044

(22) Filed: Feb. 15, 2022

(65) Prior Publication Data

US 2022/0275680 A1 Sep. 1, 2022

Related U.S. Application Data

(60) Provisional application No. 63/154,020, filed on Feb. 26, 2021.

(51) Int. Cl.

| | |
|---|---|
| ***E06B 7/18*** | (2006.01) |
| ***E06B 5/10*** | (2006.01) |
| ***E06B 3/16*** | (2006.01) |
| ***E06B 3/70*** | (2006.01) |
| ***E06B 7/20*** | (2006.01) |

(52) U.S. Cl.

CPC ..... *E06B 5/10* (2013.01); *E06B 3/163* (2013.01); *E06B 3/7015* (2013.01); *E06B 7/18* (2013.01); *E06B 7/20* (2013.01); *E06B 2003/166* (2013.01); *E06B 2003/703* (2013.01); *E06B 2003/7036* (2013.01); *E06B 2003/7051* (2013.01)

(58) Field of Classification Search

CPC ..... E06B 5/10; E06B 3/163; E06B 3/7015; E06B 7/18; E06B 7/20; E06B 2003/166; E06B 2003/703; E06B 2003/7036; E06B 2003/7051; E06B 1/12; E06B 1/52; E06B 3/822; E06B 5/18; E06B 2003/7046

See application file for complete search history.

(56) References Cited

U.S. PATENT DOCUMENTS

| | | | | |
|---|---|---|---|---|
| 4,786,758 | A | 11/1988 | Zielinski | |
| 5,569,878 | A * | 10/1996 | Zielinski | H05K 9/0001 49/303 |
| 5,786,547 | A | 7/1998 | Zielinski | |
| 6,992,246 | B2 | 1/2006 | Christou | |

(Continued)

*Primary Examiner* — Janet M Wilkens
*Assistant Examiner* — Susan M. Heschel
(74) *Attorney, Agent, or Firm* — KRIEGSMAN & KRIEGSMAN

(57) ABSTRACT

A door assembly for an electromagnetic shielded enclosure includes a metal door frame for defining a passageway into the enclosure and a door for selectively enclosing the passageway. The door includes a door leaf pivotally coupled to the frame. A set of radio frequency (RF) seals is connected to the exposed peripheral edge of a conductive plate in the door leaf. Each RF seal includes a resilient movable finger which overlies a U-shaped bracket mounted along the outer edge of the door leaf. A plurality of air cylinders is mounted within each bracket and is designed to urge the resilient finger of each RF seal into contact with the door frame.

3 Claims, 10 Drawing Sheets

(56) References Cited

U.S. PATENT DOCUMENTS

| | | | | |
|---|---|---|---|---|
| 8,925,251 | B1 * | 1/2015 | Rust | E06B 7/18 49/495.1 |
| 9,818,798 | B2 * | 11/2017 | Takeguchi | H01L 21/32139 |
| 11,277,947 | B2 * | 3/2022 | Warnock | A61N 5/10 |
| 2007/0007037 | A1 * | 1/2007 | Diaferia | H05K 9/0015 174/382 |
| 2015/0152679 | A1 * | 6/2015 | Kolobayev | E06B 5/20 49/305 |
| 2019/0383089 | A1 * | 12/2019 | Gaviglia | E06B 5/18 |
| 2020/0275586 | A1 | 8/2020 | Warnock et al. | |

* cited by examiner

DOOR ASSEMBLY FOR AN ELECTROMAGNETIC SHIELDED ENCLOSURE

CROSS-REFERENCE TO RELATED APPLICATIONS

The present application claims the benefit under 35 U.S.C. 119(e) to U.S. Provisional Patent Application No. 63/154,020, which was filed on Feb. 26, 2021 in the names of Seth Warnock et al., the disclosure of which is incorporated herein by reference.

FIELD OF THE INVENTION

The present invention relates generally to rooms designed to shield electromagnetic radiation and, more particularly, to door assemblies for electromagnetic shielded rooms.

BACKGROUND OF THE INVENTION

An electromagnetic shielded enclosure is a room which is specifically designed to attenuate low-energy (i.e., non-ionizing) electromagnetic radiation. Typically, an electromagnetic shielded enclosure incorporates an electrically conductive skin, such as a metal sheet, meshing, or screen, into each of the walls, ceiling, and flooring of the room so as to fully enclose the room interior. In this manner, the conductive skin forms a cage-like barrier which blocks the transmission of any low-energy electromagnetic radiation that may potentially create interference with electronic equipment located inside and/or outside the room.

For electromagnetic shielded enclosures, also commonly referred to in the art interchangeably as radio frequency (RF) shielded enclosures or electromagnetic interference (EMI) shielded enclosures, the passageway, or doorway, typically serves as the primary means of disruption to the effectiveness of the electromagnetic barrier. Accordingly, the construction of the door assembly for selectively enclosing the passageway for an electromagnetic shielded enclosure is of critical importance in ensuring that the room maintains adequate shielding characteristics.

The door assembly for an electromagnetic shielded enclosure typically includes (i) a metal door frame surrounding the passageway, the door frame being connected to the conductive skin which lines the room, and (ii) a door for selectively enclosing the opening defined by the frame. At least a portion of the door includes a conductive layer which is selectively connected about its periphery to the door frame by a resilient conductive seal. As a result, the door assembly is able to establish a fully enclosed RF barrier through the passageway and thereby block the transmission of low-energy electromagnetic radiation therethrough.

The design of the conductive seal utilized to establish selective contact between the frame and door often varies amongst different door assemblies. In particular, the surface on which the conductive seal is mounted as well as the means for bridging contact between metal surfaces is often modified to improve the quality and reliability of the resultant electromagnetic barrier.

For instance, in U.S. Pat. No. 6,992,246 to C. Christou, the disclosure of which is incorporated by reference, an EMI shielded room is disclosed which includes a conductive seal mounted onto the jamb of its door frame. To establish contact between the door frame and the door, a piston extends the conductive seal, which is mounted on the frame, into contact with the door to establish a conductive path therebetween.

Door assemblies for electromagnetic shielded enclosures that mount its resilient conductive seal onto the door frame have been found to suffer from a notable drawback. Specifically, mounting the conductive seal onto the door frame creates an obstruction within the passageway. Consequently, a frame-mounted seal is inherently prone to inadvertent contact, particularly by relatively large objects passing therethrough, such as equipment, hospital beds, and wheelchairs. Any inadvertent contact experienced within the passageway not only creates a nuisance condition but may ultimately result in damage to the seal that affects its operability.

In response, certain door assemblies for electromagnetic shielded enclosures have been constructed with its resilient conductive seal integrated into the door rather than the door frame. For instance, in U.S. Pat. No. 5,569,878 to S. J. Zielinski, the disclosure of which is incorporated by reference, a door assembly for an EMI shielded room is disclosed which includes a door structure, or leaf, defining an inner space in which plates are mounted for movement toward and away from the door edges. A pneumatic bladder internally located within the door leaf is design to displace the plates outward and return springs retract the plates when the bladder is vented. The outer borders of the plates carry bumpers that force flexible contact members (i.e., conductive seals) into engagement with the jamb and threshold of the doorway.

Although door assemblies of the type described in the '878 patent create a less obtrusive passageway, these types of door assemblies are typically complex in construction, since the principal mechanical components for establishing the resilient contact are all located within spaces defined within the interior of the door leaf. Additionally, it has been found that the aforementioned design is relatively unreliable because if certain components (e.g., the pneumatic bladder) malfunction over time, the construction of the door renders these components inaccessible for repair and/or replacement.

SUMMARY OF THE INVENTION

In view thereof, it is an object of the present invention to provide a novel door assembly for an electromagnetic shielded enclosure.

It is another object of the present invention to provide a door assembly as described above that is effective and reliable in shielding electromagnetic radiation.

It is yet another object of the present invention to provide a door assembly as described above which does not create any obstruction within the passageway in which it is installed.

It is still another object of the present invention to provide a door assembly as described above which has a limited number of parts, is inexpensive to manufacture, and is easy to use.

It is yet still another object of the present invention to provide a door assembly as described above which can be readily maintained to ensure proper operation after repeated usage.

Accordingly, as one feature of the present invention, there is provided a door assembly for an electromagnetic shielded enclosure, the door assembly comprising (a) a metal door frame that defines a passageway into the electromagnetic shielded enclosure, and (b) a door coupled to the door frame for selectively enclosing the passageway, the door comprising, (i) a door leaf pivotally coupled to the door frame, the door leaf comprising an outer edge shaped to define a continuous longitudinal recess, the door comprising a conductive plate having an outer periphery that is externally exposed, (ii) a radio frequency (RF) seal connected to the outer periphery of the conductive plate, the RF seal having a resilient finger that overlies the longitudinal recess in the door leaf, and (iii) a pneumatic system at least partially located within the longitudinal recess in the door leaf, (c) wherein, upon actuation, the pneumatic system articulates the resilient finger of the RF seal into contact with the metal door frame, thereby establishing complete peripheral conductive contact between the door and the metal door frame.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings, wherein like reference numerals represent like parts:

FIG. 9(*b*) is an enlarged section view of the door assembly shown in FIG. 1, taken along lines B-B, the door assembly being shown with the electromagnetic shield in its activated state, the details of the door core not being shown for ease of illustration, the RF seal being shown spaced slightly away from the conductive plate in the door leaf for ease of illustration;

FIG. 10(*b*) is an enlarged section view of the door assembly shown in FIG. 1, taken along lines A-A, the door assembly being shown with the electromagnetic shield in its activated state, the details of the door core not being shown for ease of illustration, the RF seal being shown spaced slightly away from the conductive plate in the door leaf for ease of illustration.

DETAILED DESCRIPTION OF THE INVENTION

Door Assembly 11 for an Electromagnetic Shielded Enclosure

Figure 1:
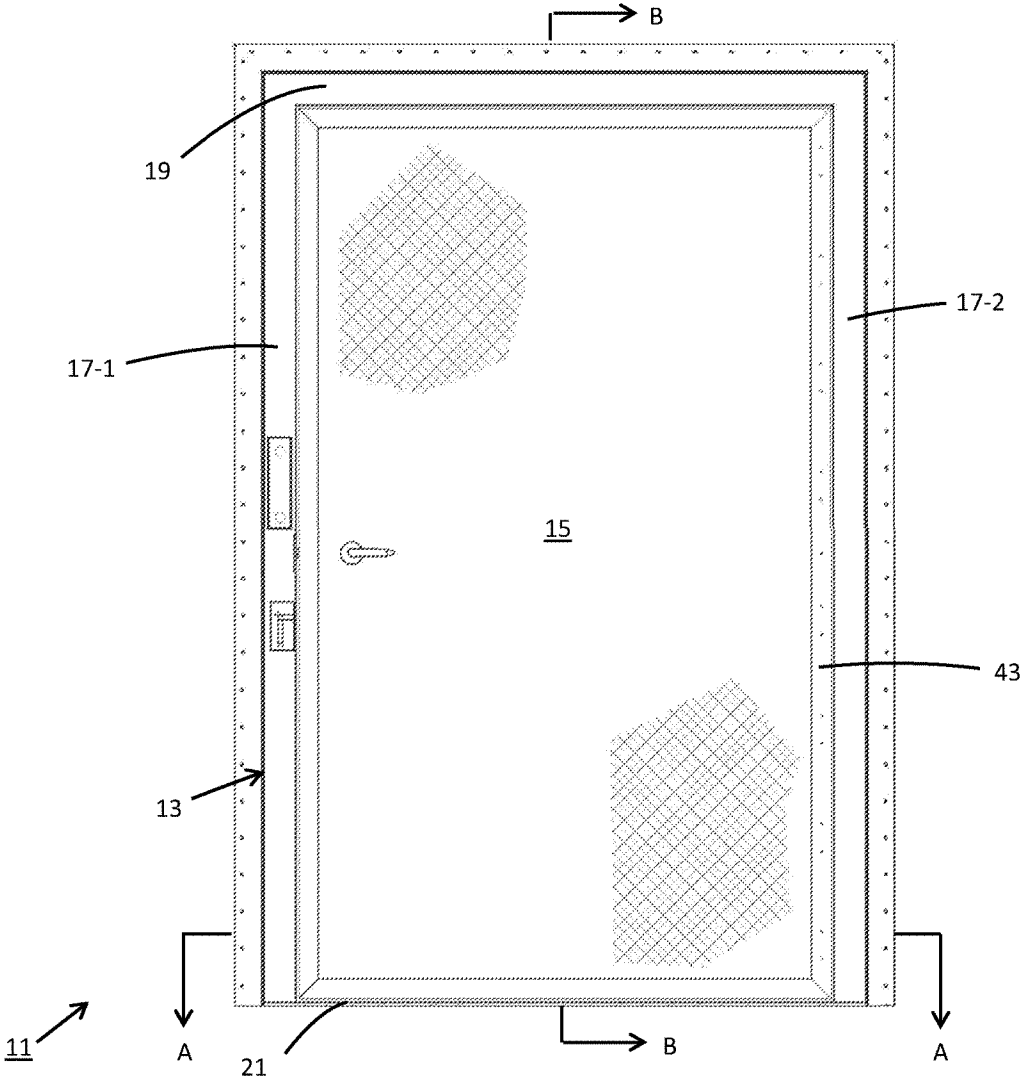
FIG. 1 is a front view of a door assembly for an electromagnetic shielded enclosure, the door assembly being constructed according to the teachings of the present invention.

Referring now to FIG. 1, there is shown a door assembly for an electromagnetic shielded enclosure, the door assembly being constructed according to the teachings of the present invention and identified generally by reference numeral 11. As will be explained in detail below, door assembly 11 is uniquely designed to provide a simple, inexpensive, and unobtrusive solution for selectively establishing an electromagnetic radiation barrier across the passageway of an EMI shielded room.

In the description that follows, door assembly 11 is described primarily in connection with the shielding of electromagnetic energy which falls within the radio frequency (RF) spectrum. However, it is to be understood that the electromagnetic shielding capabilities of door assembly 11 are not limited to RF energy, but rather could be similarly applied to block other forms of low-energy electromagnetic radiation (e.g., microwaves) without departing from the spirit of the present invention. In fact, door assembly 11 is not only designed to shield low-energy (i.e., non-ionizing) electromagnetic radiation but also capable of blocking high-energy (i.e., ionizing) electromagnetic radiation, such as x-rays and gamma rays.

Door assembly 11 comprises (i) a metal door frame 13 mounted within the open passageway of a shielded enclosure, or room, and (ii) a door 15 pivotally connected to frame 13 for selectively enclosing the open passageway. As will be explained further in detail below, door 15 is equipped with a novel RF seal about its periphery that selectively establishes a continuous electromagnetic barrier with frame 13. As a result, an effective RF barrier is created within the passageway in communication with the shielded room, thereby forming a continuous electromagnetic barrier around the room interior in all directions.

Door frame 13 extends along the periphery of the open passageway of the shielded enclosure and is preferably constructed of a conductive material, such as aluminum. Frame 13 is preferably conductively coupled to the metal skin within the walls, ceiling and flooring of the room that together forms the electromagnetic barrier for the enclosure. As a result, by constructing at least one layer of door 15 of a conductive material and selectively connecting the metal layer in the door 15 to frame 13, an electromagnetic barrier can be established which surrounds the room interior in all directions.

Door frame 13 is represented herein as comprising (i) a pair of upright, opposing jambs, or side posts, 17-1 and 17-2, (ii) a head jamb, or header, 19 extending horizontally across the top of the passageway in connection with the top ends of jambs 17, and (iii) a sill, or threshold, 21 mounted in flooring within the opening of the passageway in contact with the bottom ends of jambs 17.

As a principal feature of the present invention, the RF seal used to selectively establish peripheral conductive contact between door 15 and frame 13 is incorporated into door 15. Accordingly, when the electromagnetic barrier is deactivated and the door is pivoted open, the passageway is free from any obstructions which may otherwise impede a person and/or equipment from passing therethrough. Instead, by housing all the vulnerable mechanical components used to form the temporary RF seal within door 15, there is minimal risk of damage to such components upon entering and exiting the room.

Door 15

As noted briefly above, door 15 is pivotally coupled to frame 13 and adapted for displacement between an open position, in which the passageway remains open for entrance and/or egress therethrough, and a closed position, in which door 15 physically encloses the passageway. With door 15 pivoted closed, an RF seal can then be actuated to establish complete peripheral conductive contact between door 15 and frame 13.

Figure 2:
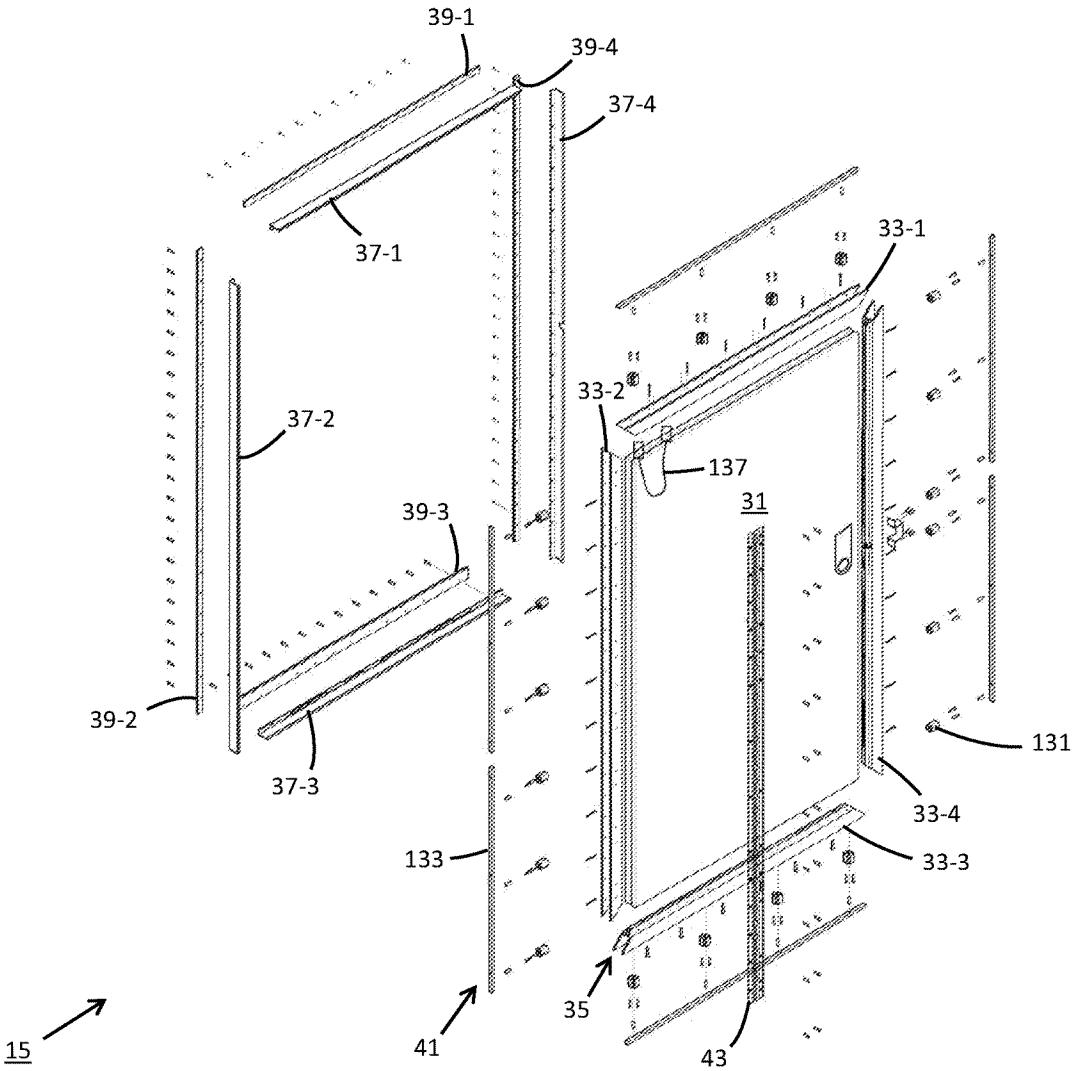
FIG. 2 is an exploded rear perspective view of the door shown in FIG. 1.

Referring now to FIG. 2, door 15 comprises (i) a generally rectangular door leaf 31, (ii) a set of generally U-shaped brackets 33-1 thru 33-4 fixedly mounted along the outer edge of leaf 31, each bracket 33 being shaped to define an open interior channel 35, (iii) a set of RF seals 37-1 thru 37-4 fixedly connected to door leaf 31, each RF seal 37 having a free end which partially overlies the interior channel 35 of a corresponding bracket 33, (iv) a set of retainer plates 39-1 thru 39-4, each retainer plate, or retainer, 39 securing a corresponding RF seal 37 to door leaf 31, (v) a pneumatic system 41 retained within interior channel 35 of brackets 33 for selectively articulating the free end of RF seals 37 away from the outer edge of leaf 31, and (vi) a hinge 43 for pivotally coupling bracket 33-2 to right-side jamb 17-2, thereby enabling door leaf 31 to pivot relative to frame 13.

Figure 3:
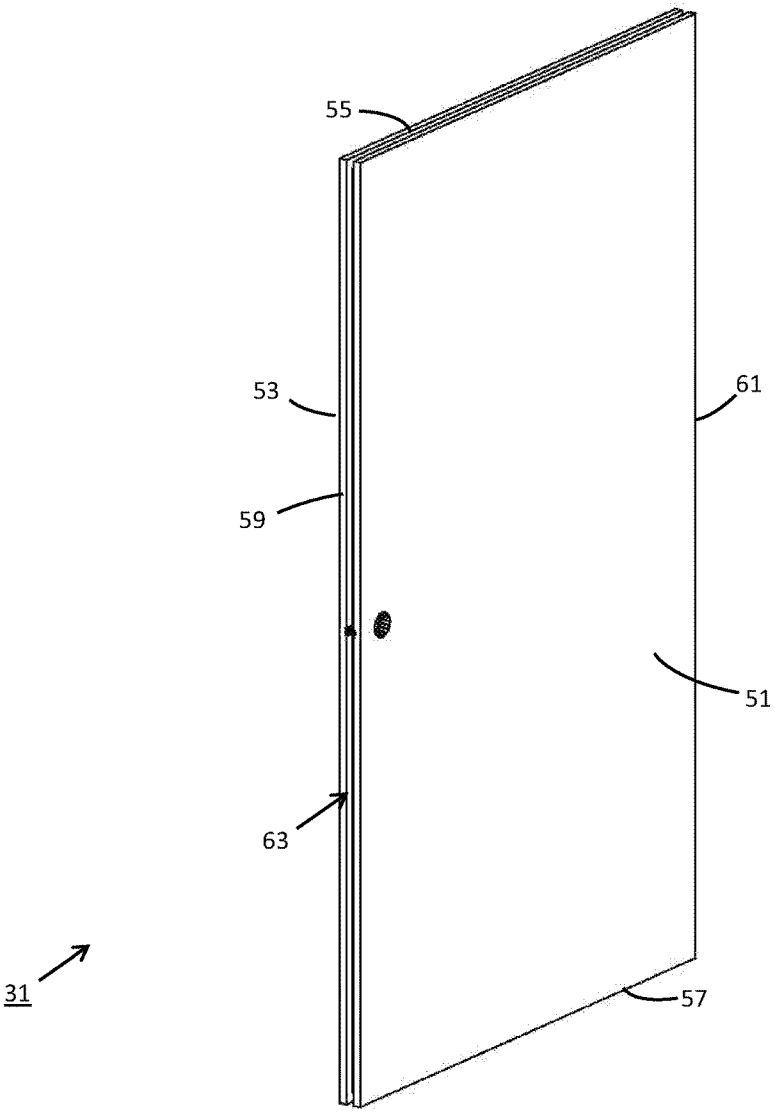
FIG. 3 is a front perspective view of the door leaf shown in FIG. 2.

As seen most clearly in FIG. 3, door leaf 31 is a unitary, generally rectangular member which includes a planar front surface 51, a planar rear surface 53, a top edge 55, a bottom edge 57, a left-side edge 59, a right-side edge 61. A continuous, generally U-shaped recess 63 is formed into the periphery of leaf 31 along top edge 55, bottom edge 57, left-side edge 59, and right-side edge 61. As will be explained further below, recess 63 serves as an interface for retaining selected mechanical components of door 15.

Figure 4:
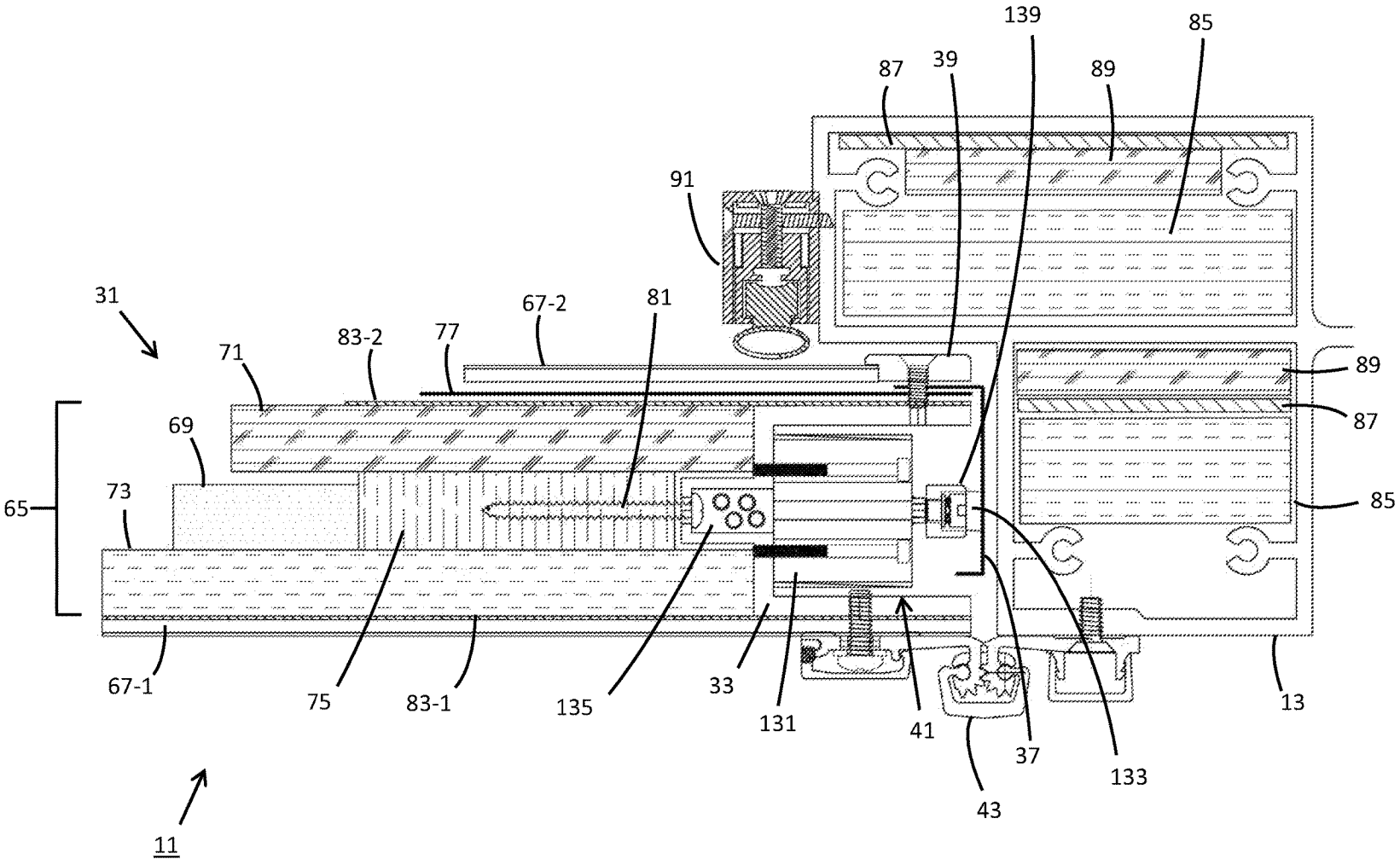
FIG. 4 is a fragmentary section view of the door assembly shown in FIG. 1, taken along lines A-A, the RF seal being shown spaced slightly away from the conductive plate in the door leaf for ease of illustration.

Door leaf 31 preferably has a multi-layered composition that provides optimal electromagnetic shielding capabilities, while maintaining a relatively lightweight, durable, and soundproof design. Specifically, as seen in FIG. 4, door leaf 31 preferably includes a core layer, or core, 65 that is disposed between opposing plastic laminate layers 67-1 and 67-2 that provide leaf 31 with an aesthetically pleasing exterior appearance.

Preferably, core 65 includes a plasterboard layer 69 disposed between a plywood layer 71 and medium-density fiberboard layer 73. Preferably, core 65 is constructed with a certain degree of open spacing provided between plasterboard layer 69 and plywood layer 71 for soundproofing purposes. Plywood layer 71 and fiberboard layer 73 extend beyond plasterboard layer 69 and are maintained in a fixed spaced relationship by a hardwood batten 75.

As a feature of the invention, a conductive plate 77 constructed of a suitable metallic material, such as copper, is disposed between core 65 and rear laminate layer 67-2. Conductive plate 77 and laminate layer 67-1 extend beyond the distal end of core 65. As a result, the periphery of conductive plate 77 is externally exposed, thereby enabling RF seals 37 to be positioned in direct contact thereagainst. Retainers 39 are then mounted over RF seal 37 in a coplanar relationship with laminate layer 67-2 in order to secure RF seal 37 against conductive plate 77.

Together, retainer 39, conductive plate 77, and front laminate layer 67-1 form a planar distal end that is shaped to define a continuous longitudinal recess, or channel, 63 which is dimensioned to fittingly receive bracket 33 when door 15 is in its assembled state. Bracket 33 is preferably retained in place within longitudinal channel 63 by driving a fastening element 81 through bracket 33 and into batten 75, as shown.

It should be noted that optional lead sheets 83-1 and 83-2 may be incorporated into the construction of door leaf 31 in order to provide leaf 31 with high-energy electromagnetic radiation shielding capabilities. In the present example, lead sheet 83-1 is shown disposed between front laminate plate 67-1 and core 65, and lead sheet 83-2 is shown disposed between conductive plate 77 and core 65. However, the number, construction, and location of lead sheets 83 could be modified without departing from the spirit of the present invention. As can be appreciated, the inclusion of one or more radiation shielding sheets 83 enables door 15 to be used in facilities with equipment that produces ionizing electromagnetic radiation, such as x-ray and magnetic resonance imaging (MRI) machines.

It is to be understood that frame 13 may also be designed with a multi-layer construction to provide similar shielding characteristics. As shown in FIG. 4, sound insulation layers 85, lead sheets 87, and chipboard layers 89 are all preferably housed within the interior of sections of frame 13 to optimize shielding performance and provide adequate soundproofing. Additionally, an acoustic seal 91 may be mounted on frame 13 or door leaf 31 to further attenuate any noise propagating through the passageway.

Figure 5:
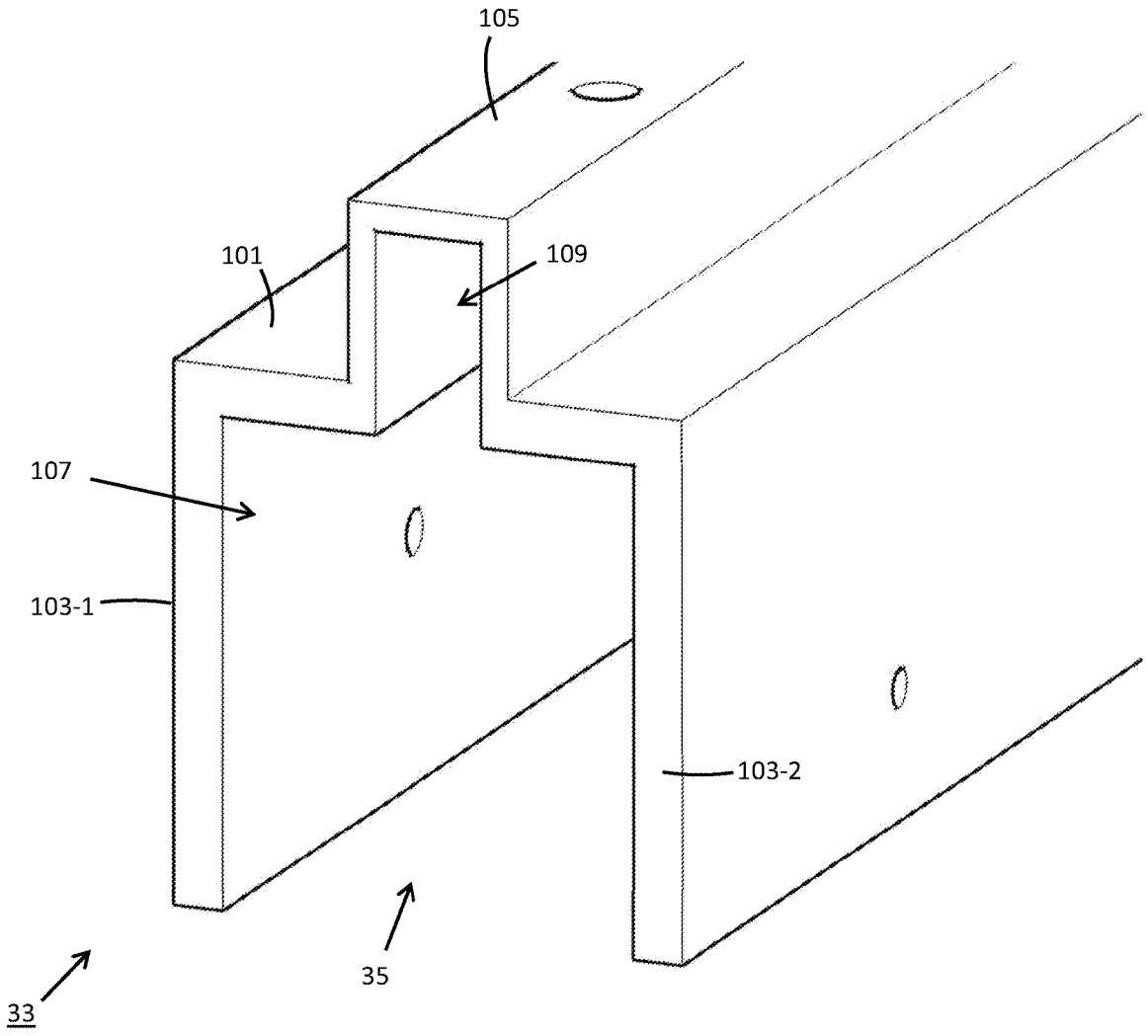
FIG. 5 is an enlarged, fragmentary, left-side view of one of the brackets shown in FIG. 2.

As noted above, brackets 33 are fixedly mounted along the periphery of door leaf 31 and serve as support structures for certain mechanical components that are used to selectively establish an RF barrier, or seal, between conductive door leaf 31 and metal door frame 13. As seen most clearly in FIG. 5, each bracket 33 is formed as an elongated, unitary member which is preferably constructed of a rigid and durable material, such as aluminum.

Specifically, each bracket 33 comprises a base wall 101 from which projects a pair of upstanding, parallel side walls 103-1 and 103-2. Additionally, a U-shaped longitudinal projection 105 is formed onto and protrudes outwardly from base wall 101. Accordingly, bracket 33 is shaped to define an open interior channel 35 with an enlarged, widened portion 107 in communication with a narrower portion 109. As will be explained in detail below, portions 107 and 109 are dimensioned to receive selected components of pneumatic system 41.

Figure 6:
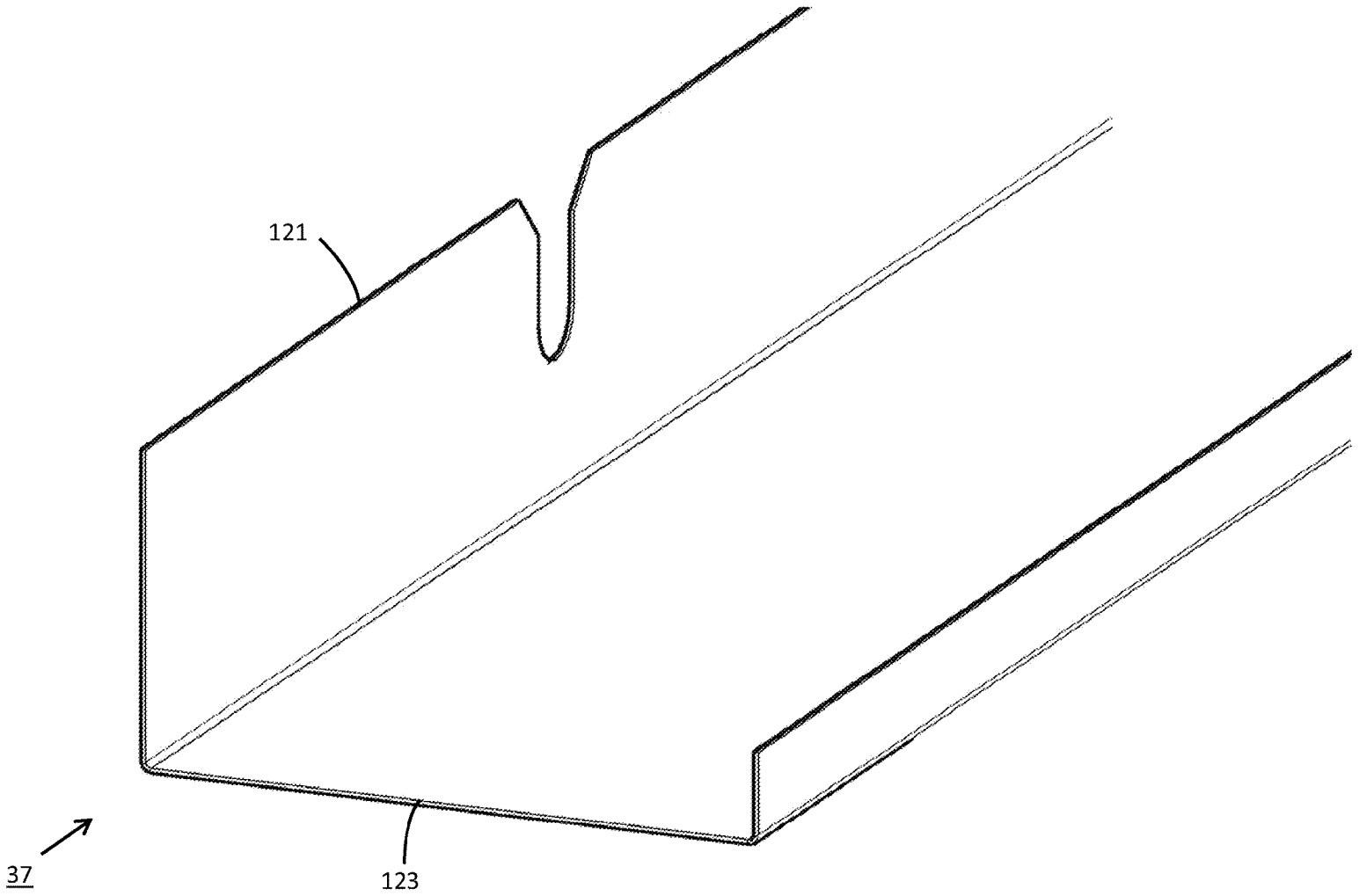
FIG. 6 is an enlarged, fragmentary, left-side view of one of the RF seals shown in FIG. 2.

As referenced above, RF seals 37 are fixedly connected to conductive plate 77 in door leaf 31 and are designed to articulate into selective contact with metal frame 13, thereby establishing a continuous RF barrier between the periphery of door leaf 31 and metal frame 13. As seen most clearly in FIG. 6, each RF seal 37 is constructed of a conductive material, such as phosphorous bronze, and includes a fixed upstanding support wall 121 from which orthogonally projects an articulating L-shaped finger 123.

Figure 7:
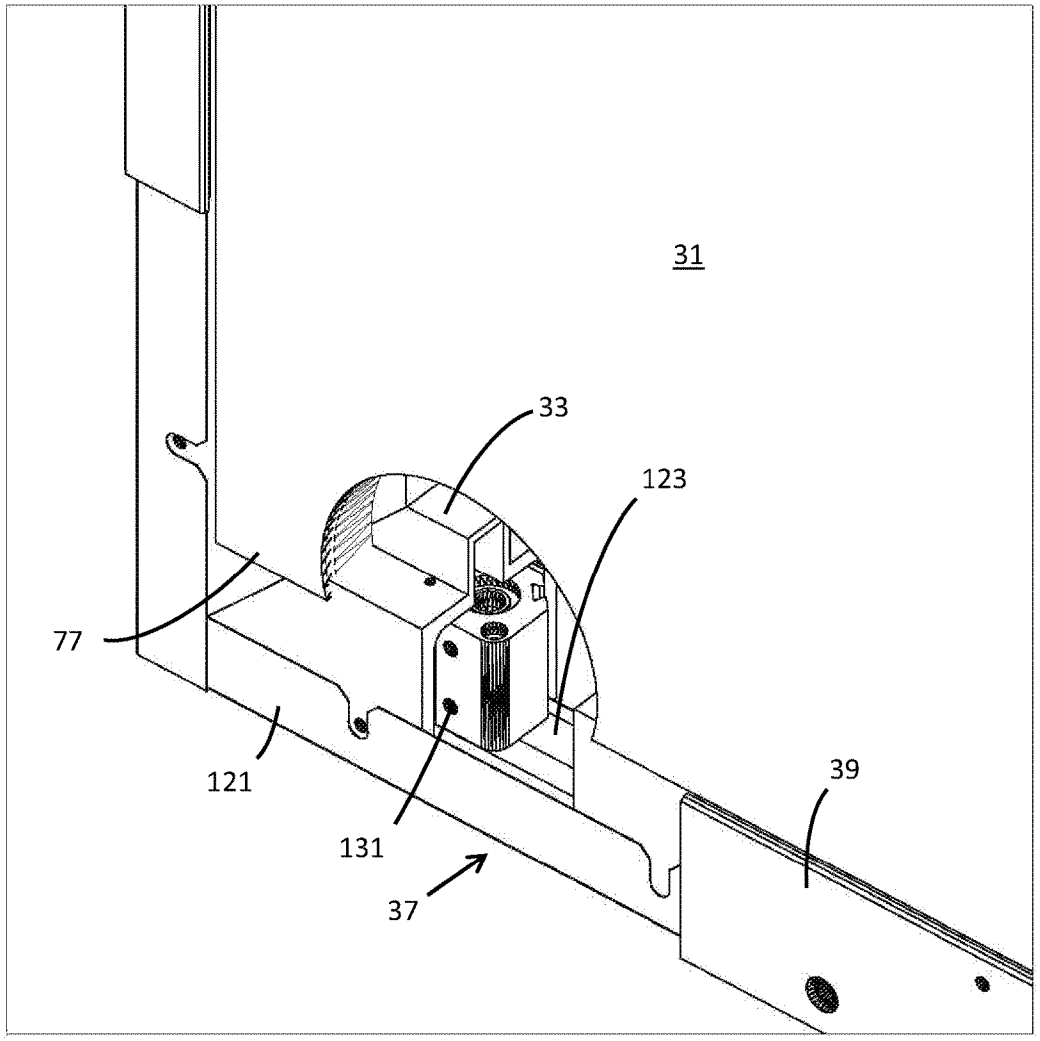
FIG. 7 is an assembled, rear perspective view of the door shown in FIG. 2, wherein selected components of the door are shown broken away in part to illustrate the interrelationship between components.

With door 31 in its assembled state, as shown in FIG. 7, fixed wall 121 of RF seal 37 is secured to conductive plate 77 in door 15 by retainer 39. With fixed wall 121 retained as such, moveable finger 123 overlies the open end of bracket 33 in a spaced apart relationship relative to door frame 13. As will be explained further below, activation of pneumatic system 41 urges articulating finger 123 away from the outer edge of door leaf 31 and into contact with metal frame 13.

As referenced above, pneumatic system 41 is retained within interior channel 35 of brackets 33 and is designed to selectively articulate finger 123 of RF seals 37 outward and into engagement with metal frame 13. As seen most clearly in FIGS. 2 and 4, pneumatic system 41 comprises (i) a plurality of air cylinders 131 fixedly mounted within interior channel 35 of brackets 33 at spaced intervals, (ii) a plurality of push bars, or rods, 133, each coupled to a selection of air cylinders 131 in order to create a linear actuation force onto articulating finger 123 of a corresponding RF seal 37, (iii) an air line 135 fixedly mounted within interior channel 35 of brackets 33 in fluid communication with each of air cylinders 131, and (iv) an armored door loop 137 mounted on one edge of leaf 31 in communication with air line 135.

As seen most clearly in FIG. 4, each air cylinder 131 is mounted within widened portion 107 of interior channel 35 and is secured in place onto bracket 33 with screws. Air cylinder 131 includes an outwardly protruding piston rod 139 when is adapted for axial displacement upon actuation. Push rod, or bar, 133 is mounted onto the distal end of piston rod 139 and is preferably in continuous contact against the interior surface of movable finger 123.

Air line 135 is preferably disposed within narrower portion 109 of interior channel 35 and is connected to the inlet port and outlet port of each air cylinder 131. In turn, air line 135 is delivered a supply of air from an external air source in communication with armored door loop 137. In this manner, a supply of air is provided to each of air cylinders 131 for actuation.

Figure 8:
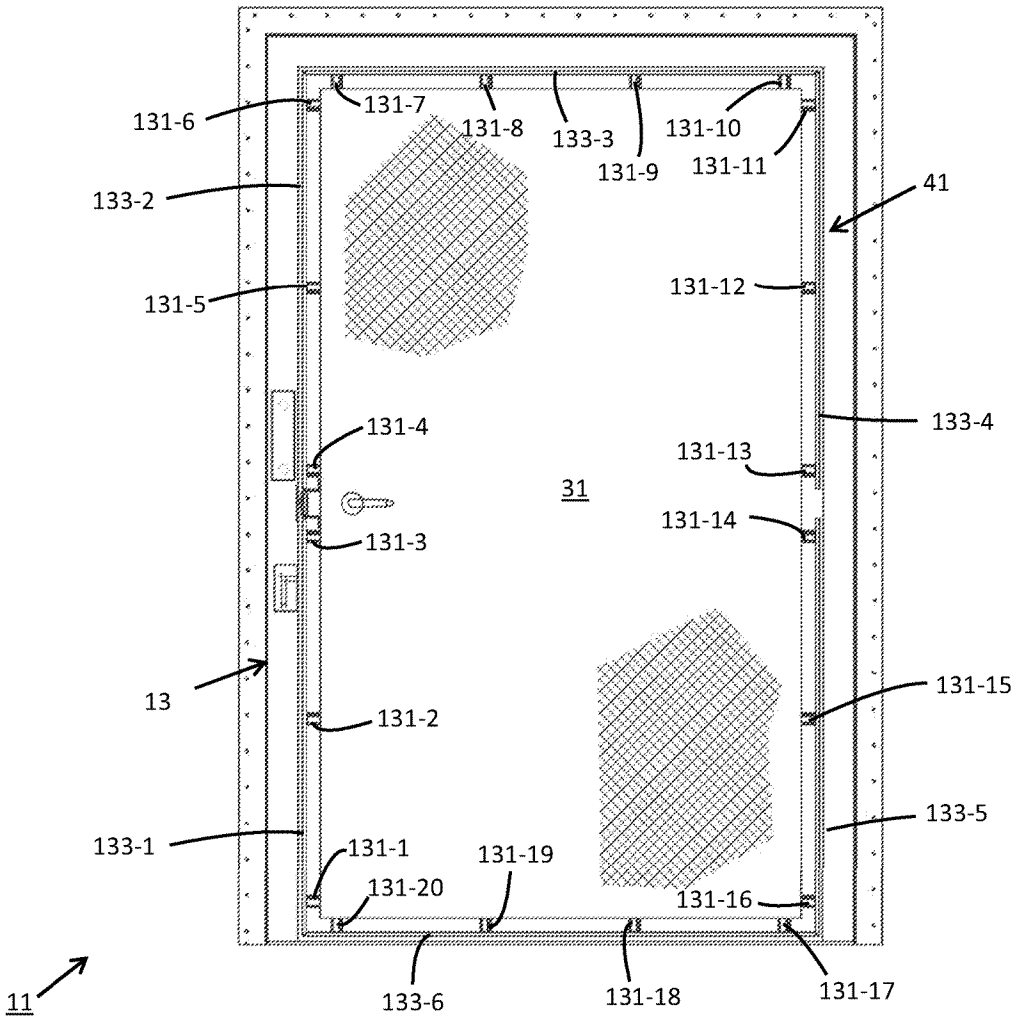
FIG. 8 is a front view of the door assembly shown in FIG. 1, the door assembly being shown with selected components removed therefrom to illustrate the arrangement of air cylinders and push rods in relation to the door leaf.

The number and arrangement of components in pneumatic system 41 are selected to optimize both the reliability and quality of the RF seal established between door leaf 31 and frame 13. Specifically, as seen most clearly in FIG. 8, air cylinders 133-1 thru 131-6 are spaced along left-side edge 59 of door leaf 31, air cylinders 131-7 thru 131-10 are spaced along top edge 55 of door leaf 31, air cylinders 131-11 thru 131-16 are spaced along right-side edge 61 of door leaf 31, and air cylinders 131-17 thru 131-20 are spaced along bottom edge 57 of door leaf 31.

Furthermore, push bar 133-1 is coupled to the piston rod 139 of air cylinders 131-1 thru 131-3, push bar 133-2 is coupled to the piston rod 139 of air cylinders 131-4 thru 131-6, push bar 133-3 is coupled to the piston rod 139 of air cylinders 131-7 thru 131-10, push bar 133-4 is coupled to the piston rod 139 of air cylinders 131-11 thru 131-13, push bar 133-5 is coupled to the piston rod 139 of air cylinders 131-14 thru 131-16, and push bar 133-6 is coupled to the piston rod 139 of air cylinders 131-17 thru 131-20.

As can be seen, each linear push bar 133 is driven by at least three air cylinders 131 coupled thereto at spaced intervals along its length. The use of multiple air cylinders 131 to drive each push bar 133 not only ensures an adequate seal is established along the entire periphery of door leaf 31 but also creates operational redundancy in case certain air cylinders 131 malfunction.

Operation of Door Assembly 11

In use, door assembly 11 is designed to operate in the following manner. With door 15 disposed in its open position, individuals (e.g., patients or healthcare personnel) are able to easily enter into and/or exit from the room interior through the passageway. It is important to note that, with door 15 disposed in its open position, sensitive mechanical components that are used to selectively establish an RF barrier are retained entirely within door 15 and, as such, are located away from the passageway. Accordingly, people and/or equipment can be maneuvered through the passageway without any obstructions that could otherwise be susceptible to damage.

Figure 9B:
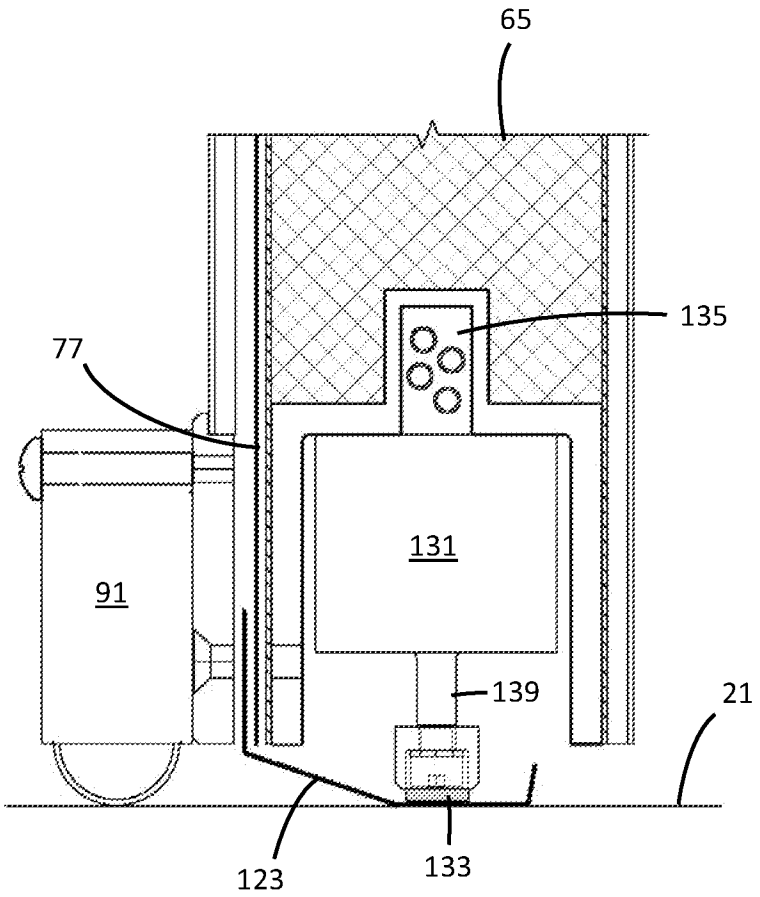
FIG. 9(*a*) is an enlarged section view of the door assembly shown in FIG. 1, taken along lines B-B, the door assembly being shown with the electromagnetic shield in its deactivated state, the details of the door core not being shown for ease of illustration, the RF seal being shown spaced slightly away from the conductive plate in the door leaf for ease of illustration.
Figure 9A:
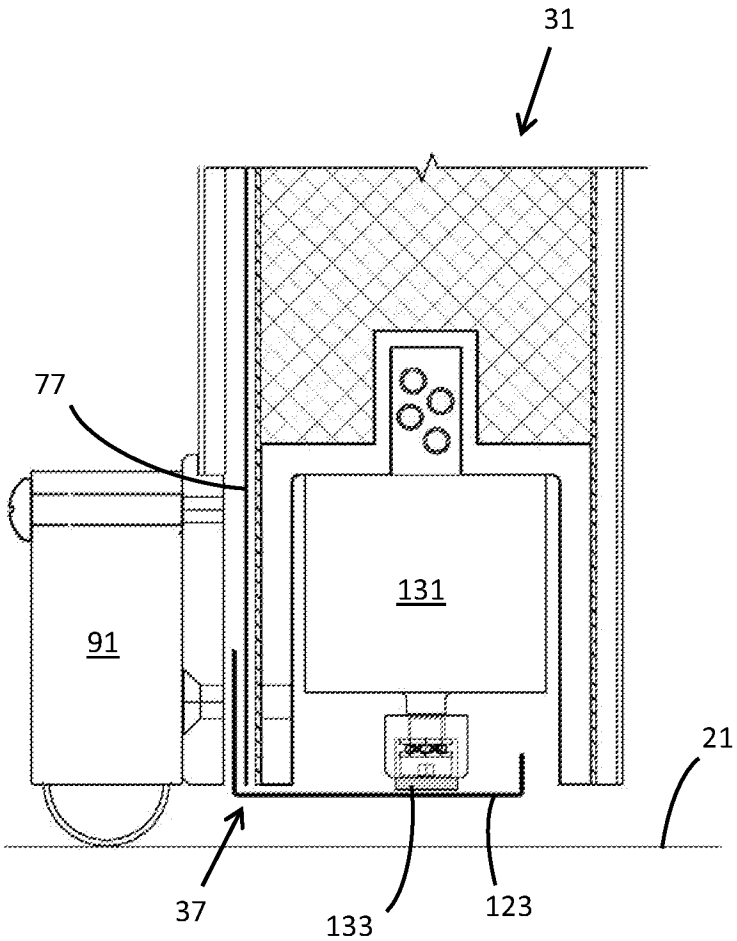
Figure 10B:
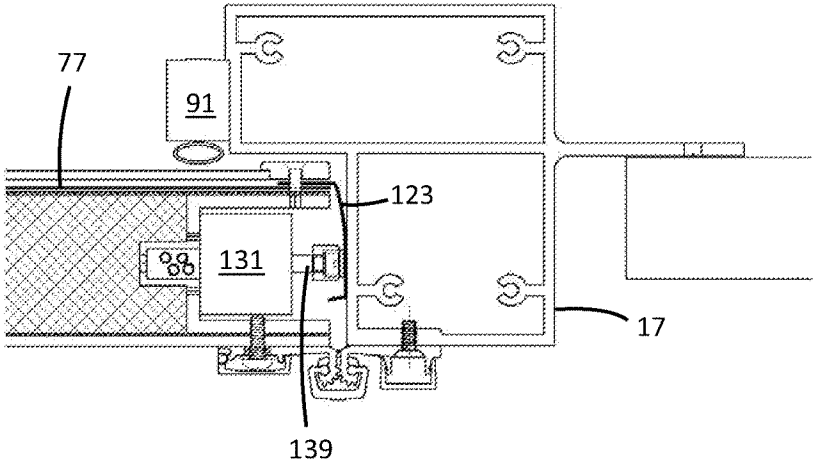
FIG. 10(*a*) is an enlarged section view of the door assembly shown in FIG. 1, taken along lines A-A, the door assembly being shown with the electromagnetic shield in its deactivated state, the details of the door core not being shown for ease of illustration, the RF seal being shown spaced slightly away from the conductive plate in the door leaf for ease of illustration.
Figure 10A:
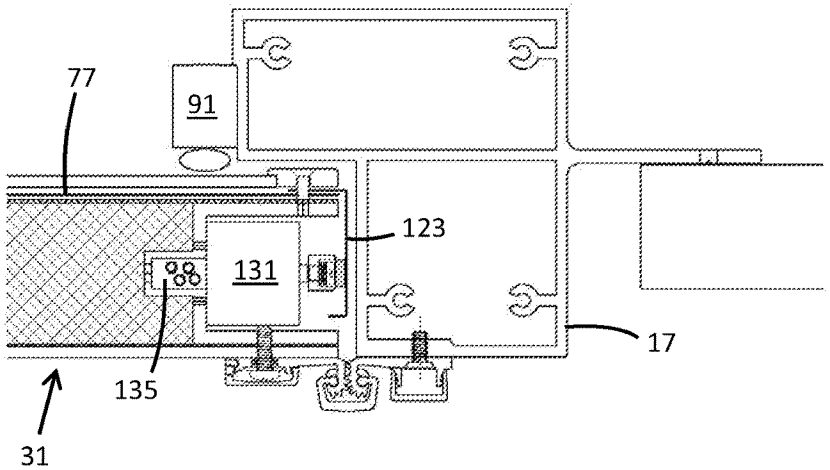

When medical treatment activities are undertaken with the room, door 15 is pivoted into its closed position. As door 15 is pivoted closed, it is important to note that L-shaped finger 123 of RF seal 37 remains spaced away from door frame 13 to provide adequate clearance, as seen in FIGS. 9(*a*) and 10(*a*).

Thereafter, an operator activates the RF barrier between door 15 and frame 13 through a designated control panel (not shown). Activation of the RF barrier results in the actuation of all air cylinders 131 in door 15. As seen in FIGS. 9(*b*) and 10(*b*), each piston rod 139 is driven linearly outward upon actuation of air cylinders 131. The outward displacement of piston rods 139 urges L-shaped finger 123 of RF seal 37 into contact with door frame 13. More specifically, RF seal 37-1 is disposed in contact against header 19, RF seal 37-2 is disposed in contact with jamb 17-2, RF seal 37-3 is disposed in contact with sill 21, and RF seal 37-4 is disposed in contact with jamb 17-1.

As a result, a continuous region of conductive contact (i.e., a conductive seal) is thereby established between metal door frame 13 and conductive plate 77 of door leaf 31. Because door frame 13 is conductively coupled to an RF shield integrated into the walls, ceiling, and flooring of the room, a fully encompassing electromagnetic shield is effectively formed around the entirety of the room interior. Consequently, any low-energy (i.e., non-ionizing) electromagnetic radiation, which may otherwise create RF interference, is incapable of transmission into or from the room interior. Additionally, due to the presence of lead sheets 83 in door leaf 31 and lead sheets 87 in door frame 13, door assembly 11 is additionally capable of shielding any high-energy (i.e., ionizing) electromagnetic radiation, such as x-rays and gamma rays.

Upon completion of any radiation producing activities within the room, air cylinders 131 are deactivated. The release of air from air cylinders 131 into the designated port in air line 135 results in the retraction of piston rods 139. As a result, L-shaped finger 123 of RF seals 37 resiliently returns to its original configuration away from contact against door frame 13. With adequate clearance established between RF seals 37 and door frame 13, door 15 can be pivoted back to its open position, thereby yielding access to the room interior.

As a feature of the present invention, the principal mechanical components used to establish an RF barrier between frame 13 and door 15 are all located either within U-shaped recess 63 or otherwise along the distal edge of door leaf 31. By locating these mechanical components along the outer edge of door leaf 31, as opposed to within an internal space or void, all components remain readily accessible for replacement and/or repair, if needed. Accordingly, door assembly 11 can be easily maintained to ensure reliable operation.

The invention described in detail above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A door assembly for an electromagnetic shielded enclosure, the door assembly comprising:

(a) a metal door frame that defines a passageway; and (b) a door coupled to the door frame for selectively enclosing the passageway, the door comprising, (i) a door leaf pivotally coupled to the door frame, the door leaf comprising an outer edge shaped to define a continuous longitudinal recess, the door leaf comprising a conductive plate having an outer periphery that is externally exposed, (ii) a plurality of radio frequency (RF) seals connected to the outer periphery of the conductive plate, each RF seal being constructed of a conductive material, each RF seal having a resilient finger that overlies the longitudinal recess in the door leaf, and a support member from which the resilient finger integrally extends, the support member being fixedly connected to the conductive plate in the door leaf, (iii) a pneumatic system at least partially located within the longitudinal recess in the door leaf, the pneumatic system comprising, (A) a plurality of air cylinders located within the recess in the outer edge of the door leaf, each air cylinder comprising a piston rod adapted for axial displacement, the piston rod being adapted to articulate the resilient finger of the RF seal, (B) an air line located at least partially within the recess in the outer edge of the door leaf, the air line being in fluid communication with each of the plurality of air cylinders, wherein air is selectively delivered to and vented from each of the plurality of air cylinders by the air line, and (C) a plurality of push bars, each push bar being coupled to the piston rod of a selection of multiple air cylinders, each push bar being disposed in continuous contact against a corresponding RF seal, (iv) a retainer plate mounted over the support member of the RF seal for securing the RF seal against the conductive plate, and (v) a bracket configured to be matingly received and mounted within the longitudinal recess in the door leaf, the bracket being generally U-shaped in transverse cross-section and shaped to define an interior channel which is accessible through an open distal end, each of the plurality of air cylinders being mounted within the interior channel of the bracket, (c) wherein the resilient finger of the RF seal overlies the open distal end of the bracket, and wherein, upon actuation, the pneumatic system articulates the resilient finger of the RF seal into contact with the metal door frame, thereby establishing complete peripheral conductive contact between the door and the metal door frame.

2. The door assembly as claimed in claim 1 wherein the door leaf comprises a core layer disposed between opposing plastic laminate layers, the conductive plate being disposed between the core layer and one of the plastic laminate layers.

3. The door assembly as claimed in claim 2 wherein the door leaf additionally comprises at least one sheet with high-energy radiation shielding capabilities.

* * * * *